United States Patent [19]

Lyons et al.

[11] 4,380,264

[45] Apr. 19, 1983

[54] SURVEY TOOL STRING

[75] Inventors: William C. Lyons; Scot L. Scurlock, both of Sante Fe, N. Mex.

[73] Assignee: Drilling Development, Inc., Houston, Tex.

[21] Appl. No.: 219,922

[22] Filed: Dec. 24, 1980

[51] Int. Cl.[3] ..... E21B 41/00; E21B 47/00

[52] U.S. Cl. ..... 166/169; 166/241

[58] Field of Search ..... 166/162, 169, 241, 64, 166/65 M, 60, 65 R, 69, 250, 254, 255; 324/303, 340; 73/152; 175/320, 45, 50

[56] References Cited

U.S. PATENT DOCUMENTS

| | | | |
|---|---|---|---|
| 2,594,551 | 4/1952 | Gist | 166/241 |
| 3,104,711 | 9/1963 | Haagensen | 166/60 |
| 3,123,141 | 3/1964 | Towell | 166/60 |
| 4,223,746 | 9/1980 | Tanguy | 175/45 |

*Primary Examiner*—Stephen J. Novosad
*Assistant Examiner*—Joseph Falk
*Attorney, Agent, or Firm*—Vinson & Elkins

[57] ABSTRACT

A tool for housing a magnetic directional survey instrument for inserting the instrument into a deviated well bore. Means are provided on the tool for circulating well fluids past the tool while it is in the well bore. There is provided means, connectable on the tool, for centering the tool in the vertical, as well as the deviated portion of a well bore.

14 Claims, 10 Drawing Figures

FIG. 3
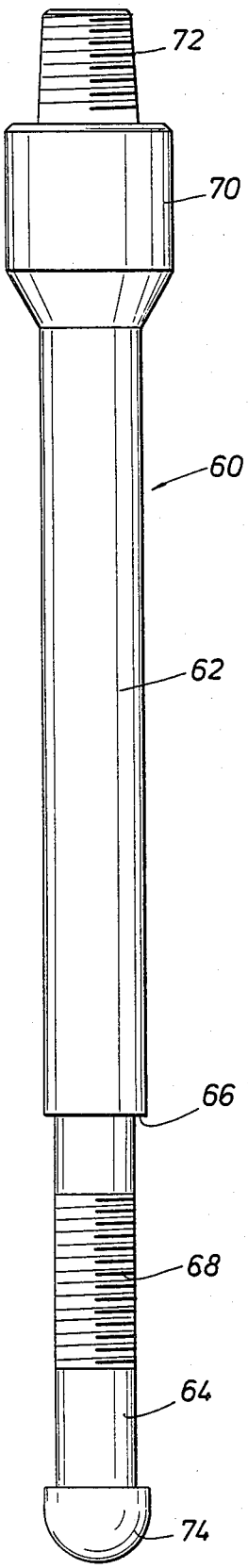
FIG. 4
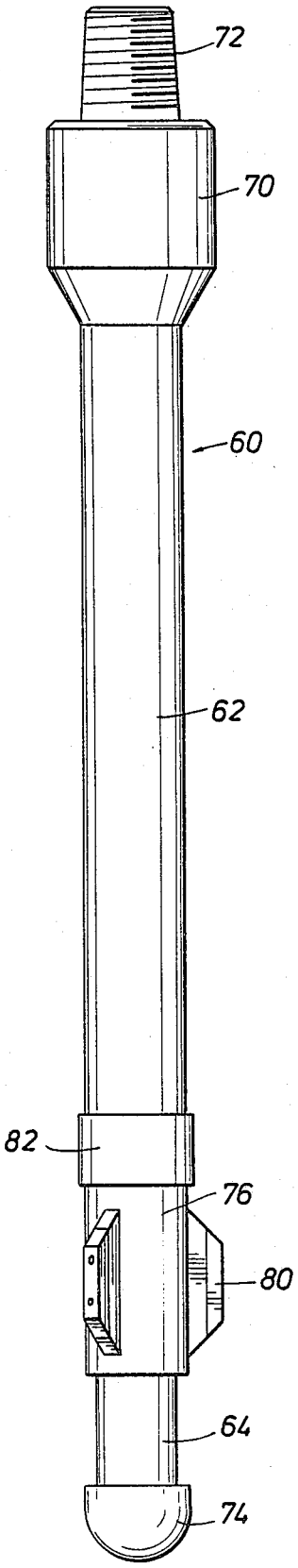
FIG. 5A
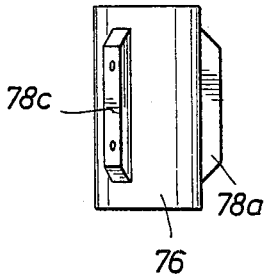
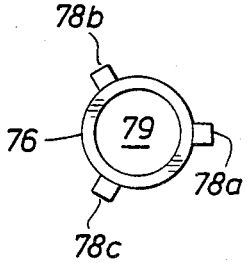
FIG. 5B

SURVEY TOOL STRING

BACKGROUND OF THE INVENTION

A. Field of the Invention

The invention is directed to a tool for holding a magnetic directional survey instrument for inserting the instrument into a deviated well bore.

B. Prior Art

In the practice of directional drilling it is very important to determine and verify accurately the hole inclination and directional orientation of the deviated well bore. A number of companies have developed various methods and equipment to achieve these purposes.

Typical of the survey instruments available today is the magnetic multi-shot survey instrument manufactured by Scientific Drilling Controls. Their survey instrument is described and illustrated at pages 6420 and 6421 of the *Composite Catalog of Oil Field Equipment and Services,* 34th Ed., Vol. 4, 1980–81.

A similarly operated survey instrument is offered by Sperry-Sun and is described and illustrated on pages 6636 and 6637 of the *Composite Catalog.* These instruments are composed of a compass, lens, film magazine, solenoid, battery housing and batteries and often some type of electronic program Also, the self-contained assembly is housed in some type of protective housing.

Typically, the survey instrument is carried or lowered into non-magnetic drill collars and the survey record taken while the drill stem is being pulled from the hole. Alternatively, the instrument may be run in an open hole on wire or other similar equipment.

With the advent of short radius curves in kicking off from vertical bore holes, it has been found that use of the above methods of hole insertion is impractical. Very often, the survey tool is damaged or rendered inoperative by the previously known methods of surveying. There has not been available a tool for housing the survey instrument which would be capable of both protecting the instrument from the downhole environment and still be capable of traversing the short radius curve.

OBJECTS OF THE INVENTION

It is an object of the invention to provide a tool for holding a magnetic directional survey instrument.

It is a further object to provide a tool for holding a magnetic directional survey instrument and which is capable of travering a short radius curve of a deviated well.

Another object of the invention is to provide a tool for holding a magnetic directional survey instrument and when run into a well hole which is deviated from the perpendicular, maintains the survey instrument in a position which is essentially parallel to the walls of the deviated portion of the well.

Another object of the invention is to provide a tool capable of protecting a magnetic directional survey instrument contained therein from the environmental hazards downhole.

These and other objects and features of this invention, and the advantages thereof, will be apparent from the following detailed description of the preferred embodiments of the invention when read in conjunction with the accompanying drawings.

BRIEF DESCRIPTION OF THE DRAWINGS

In the drawings, wherein like numerals indicate like parts, and wherein an illustrative embodiment of this invention is shown:

FIG. 3 is a schematic view of one embodiment of the tool of the invention, adapted for receiving hole-centering means.

FIG. 4 is a schematic view of the embodiment of the tool illustrated in FIG. 3 having the hole-centering means mounted thereon.

FIG. 5A is a longitudinal, schematic view of the hole-centering means.

FIG. 5B is an end view of the hole-centering means.

DESCRIPTION OF THE PREFERRED EMBODIMENTS

The tool 10 of the present invention is adapted for connection to some means (not shown) for lowering the tool 10 into the short radius curve of a deviated well. Thus positioned within the curve, and even extending into the straight portion of a deviated well, the magnetic directional survey instrument contained therein can determine the hole inclination, as well as the directional orientation of the drill path.

Figure 1:
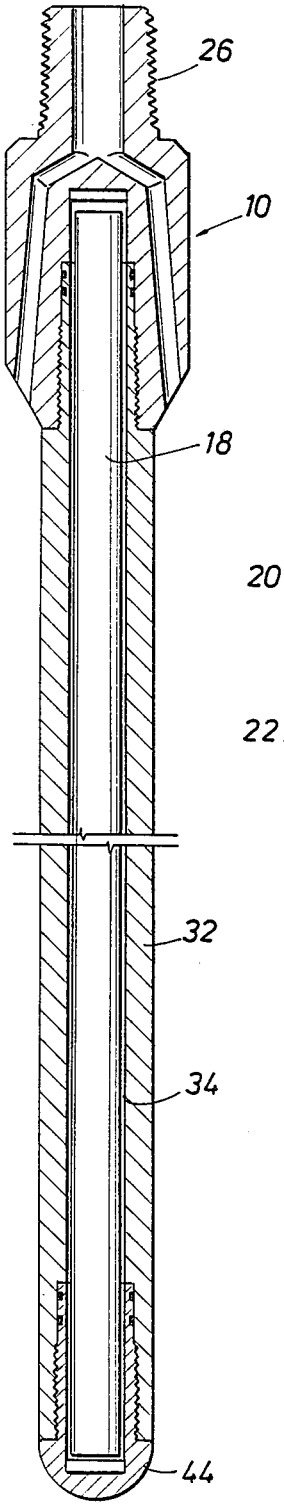
FIG. 1 is a cross-sectional view of the assembled tool of the invention containing a magnetic directional survey instrument.

Referring to FIG. 1, there is illustrated the tool 10 of the invention, adapted on one end thereof for connection to, preferably, a flexible tool string (not shown). This connector means 12 preferably has a threaded 26 pin end, with the threads 26 being of any standard size for being mated with oil field tubular goods. A typical flexible drill pipe that would be suitable for use with the present invention is taught in U.S. Pat. No. 2,515,366 (issued to J. A. Zublin).

Figure 2:
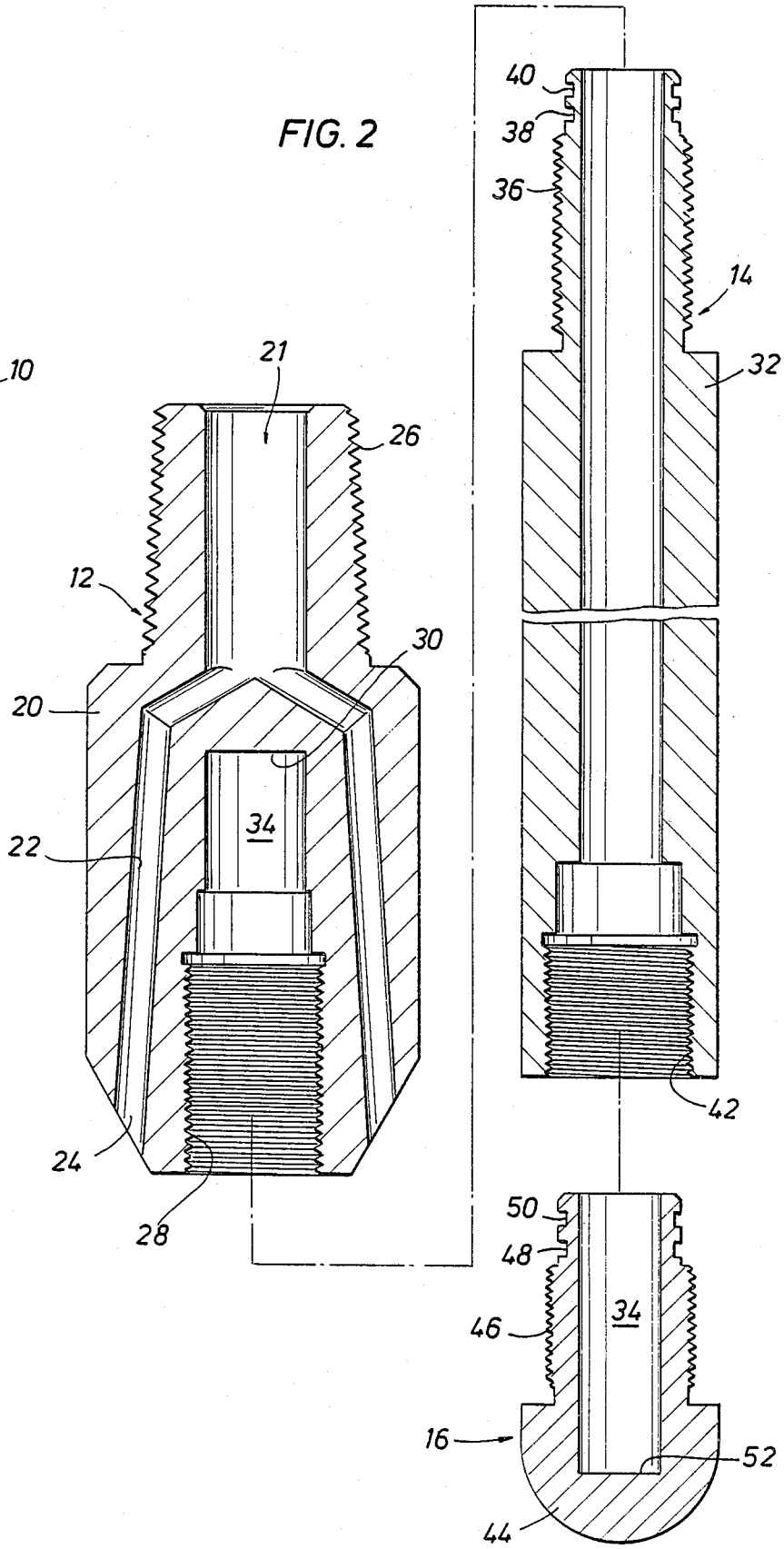
FIG. 2 is an exploded, cross-sectional view of the component parts of the tool of the invention.
Figure 6:
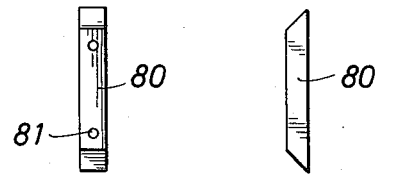
FIG. 6 are the side and plan views of wear pads which are useful for attachment to the hole-centering means of FIGS. 5A and B.

The embodiment of the tool 10, illustrated in FIGS. 1 and 2, is preferably comprised of three subassemblies. The primary subassembly is a housing 14 which is formed by tubular housing 32 of non-magnetic material. The tubular housing 32 has a longitudinal passageway 34 for holding at least a portion of a survey instrument 18, as seen in FIG. 1.

In the embodiment of the housing 32 illustrated in FIG. 2, there is provided a fluid seal with the connector subassembly 12. This reduces the possibility of well fluids entering the tool 10 when fully assembled and housing the survey instrument 18.

For assembly purposes, suitable threads 36 are provided on the upper end of the tubular housing 32 for connecting the housing 32 to the connector means 12. The connector means 12 is comprised of a housing 20 having an internal receptacle threaded 28 to receive the matching threads 36 of the upper end of the tubular housing 32. The internal receptacle preferably has an upper end 30 forming the upper terminal end of a chamber 34 formed when the tool 10 is fully assembled. If necessary, there is thus provided additional room for housing at least a portion of the survey instrument 18.

In a preferred embodiment of the invention the connector means housing 20 is provided with a fluid passageway 22 for conducting fluids from the flexible drill pipe (not shown), entering an upper fluid entry 21 to the connector housing 20, to the exterior of the tool 10. Thus, drilling fluids can be circulated in the bore hole during the taking of the magnetic survey with the tool 10.

The remaining subassembly is a closure means 16 consisting of a threaded 46 bull plug 44. The bull plug 44 is preferably constructed of brass. This is due to the physical punishment inflicted on the bull plug 44 when the tool 10 is inserted into the short radius curve. The brass construction is capable of repeated use without being severely damaged, necessitating frequent replacement. It is also important to use a material that will resist rupture that would allow well fluids to enter the interior chamber 34 of the tool 10.

Additionally, fluid seal means 48 and 50 are provided on the bull plug 44 for coaction with the interior of the tubular housing 32 to resist entry of fluids through the threaded connection 46 and 42 between the bull plug 44 and the tubular housing 32.

It is preferred that double O-ring seals be used in the connection between the connector means housing 20 and the tubular housing 32, as well as in the connection between the bull plug 44 and the tubular housing 32.

In the embodiment of the invention shown in FIGS. 1 and 2, there is provided an internal chamber 34 in the bull plug 44, having an end 52 which provides one end of the internal housing chamber 34 in the tool 10 for holding the survey instrument 18. Of course, this is not necessary and the bull plug 44 can be just a closure means or cap for the tool 10.

It will be appreciated that there are several modifications that can be made to the tool 10 within the full scope of the invention. The non-magnetic subassemblies can be one piece with the threaded bull plug 44 being removable for insertion of the survey instrument 18. In like manner, other means can be used for connecting together the subassemblies 12, 14 and 16.

Figure 7A:
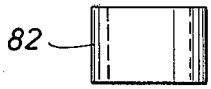
FIGS. 7A and B are the side and plan views, respectively, of hole-centering means of FIGS. 5A and B.
Figure 7B:
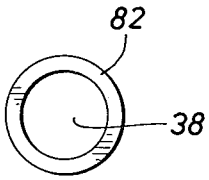
Figure 8:
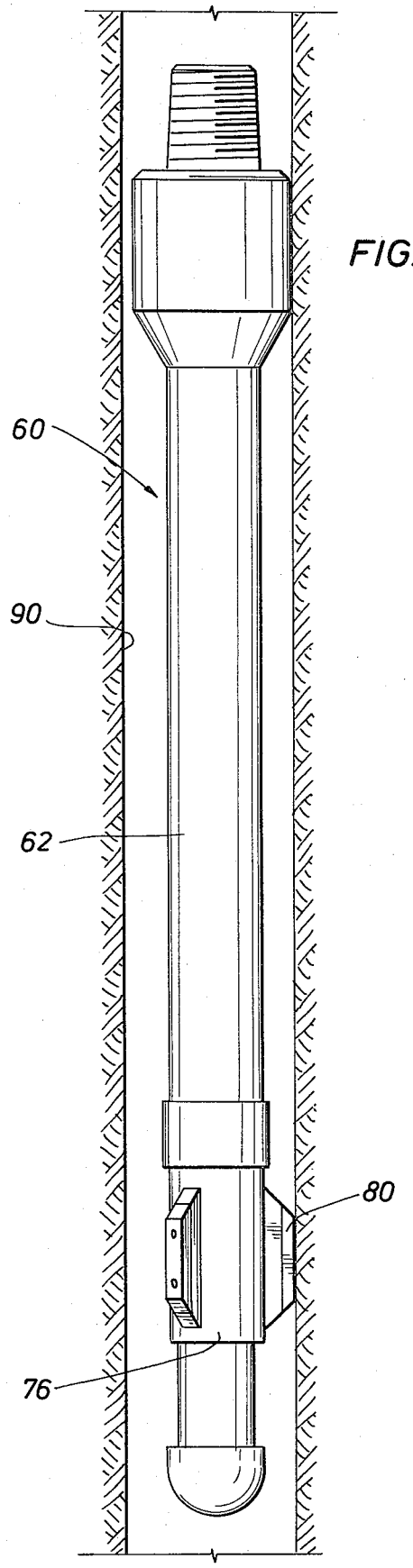
FIG. 8 is a schematic view of the tool of the invention, having centering means placed thereon, positioned in a well hole which is deviated from the perpendicular.

Another embodiment of the present invention is illustrated in FIGS. 3, 4 and 5. In this embodiment, the exterior of the tubular housing 62, of the tool 60, has been adapted to receive a tubular means 76 for centering the tool 60 in the well hole, as illustrated in FIG. 7. The schematic illustration of FIG. 7 should be viewed to represent the deviated portion of a well, which may be essentially horizontal, as opposed to the vertical drill path of the well. The tool 10 must traverse an essentially horizontal, as opposed to the vertical drill path of the well. The tool 10 must traverse an essentially short radius curve to arrive at the point illustrated in FIG. 7.

In order for the survey instrument, which is housed in the tool 60, to obtain an accurate determination of the hole inclination, it is useful to have the survey instrument positioned essentially parallel to the walls 90 of the well hole. Thus, since the connector means housing 70 is normally the largest circumference component of the tool 60, a centering means 76 is preferably provided to be positioned on the tool 60 in a manner whereby the circumference of the centering means 76 with its wear pads 78 and 81 is essentially the same as the circumference of the connector means housing 70.

The tool 60 illustrated in FIG. 3 is shown to comprise a tubular housing 62 having a portion 64 thereof of a reduced diameter. This reduced diameter portion 64 of the tubular housing 62 will be referred to as the "lower" housing. In the embodiment illustrated in FIG. 3, the lower housing 64 is shown having threads 68 cut thereon for threadedly securing the centering means 76, which preferably has matching threads on its interior walls (not shown).

It is to be understood, of course, that the centering means can be attached to the tool 60 in ways other than by using threaded connections. For example, the centering means could be welded to the tubular housing 62. Also, the lower housing 64 can be of such dimension that when the centering means 76 is placed thereon the ball cap 74 would hold the centering means on the lower housing 64.

Referring to FIGS. 5A and 5B, the centering means 76 is shown to comprise a tubular housing having a longitudinal passage 79 and having affixed thereto a plurality of wear members 78*a*, 78*b* and 78*c*. These wear members 78 may be either permanently affixed, by welding, or may be connected to the centering means 76 in a manner that permits their replacement when they become worn or broken.

In a preferred embodiment, an additional wear member 80 may be attached to each of the centering means 76 wear member 78. Preferably, these additional wear members 80 can be attached thereto using stainless steel, non-magnetic screws 81. The additional wear members 80 are preferably made of brass because of their need to withstand the abrasive nature of the well hole walls 90. The centering means 76, and wear members 78, may be non-magnetized stainless steel.

Preferably, when installing the centering means 76 on the lower housing 64 of the tool 60, a brass shoulder ring 82 should be positioned between the centering means 76 and the upper shoulder 66 which is the upper limit of the lower housing 64. The shoulder ring 82 is a tubular member having a longitudinal passageway 83 to allow the ring 82 to be slipped onto the lower housing 64 of the tool 60.

If desired, a second shoulder ring 82 could be positioned on the lower housing 64 between the centering means 76 and the ball cap 74.

However, since the connector housing 70 and the centering means 76 (with wear members 78 and 80) each have essentially the same circumference, it is preferable to be able to alter the placement of the centering means 76 on the lower housing 64. In this manner, it will be possible to provide a tool 60 capable of entering holes of varying sizes and radii.

A threaded pin end 72 is provided on the tool 60 so that the tool 60 may be connected to suitable tubular goods (not shown) for insertion into the well, as previously described.

This is accomplished by using shoulder rings 82 of varying lengths. This will then control the distance between the end of the tool 60 and the centering means 76.

What is claimed is:

1. A tool for holding a magnetic directional survey instrument comprising:

a tubular, non-magnetic housing having a central bore for holding a major portion of said survey instrument;

closure means for enclosing one end of said tubular housing, said closure means having sealing means coacting with said tubular housing to prevent fluids from entering said tubular housing and having a recess in longitudinal alignment with said bore of said housing and adapted to hold a portion of said survey instrument;

connector means connected to the other end of said tubular housing for joining said tubular housing to means for lowering said tool into a short radius curve of a deviated well;

said connector means having a passageway for conducting fluids from the interior of said tool lowering means to the exterior of said tubular housing and having a recess in longitudinal alignment with said bore of said housing and adapted to hold a portion of said survey instrument, and said connector means and said tubular housing having means to prevent fluids from entering said tubular housing.

2. The tool of claim 1, including means for centering said tool within a well bore, whereby the longitudinal axis of said tubular housing would be maintained essentially parallel to the walls of a well bore when said tool is inserted in said well bore.

3. The tool of claim 2, wherein said centering means comprises a tubular sleeve mounted on said tubular housing, said tubular sleeve having a plurality of wear members attached thereto and extending radially therefrom, said radially extending wear members defining the circumference of the centering means.

4. The tool of claim 3, wherein the circumference of the centering means is essentially equal to the maximum circumference of the connector means.

5. The tool of claim 1, wherein said connector means is non-magnetic.

6. The tool of claims 1 or 5, wherein said closure means is brass.

7. A tool for holding a magnetic directional survey instrument comprising:

a tubular, non-magnetic housing for holding at least a portion of said survey instrument;

closure means for enclosing one end of said tubular housing, said closure means having sealing means coacting with said tubular housing to prevent fluids from entering said tubular housing;

connector means connected to the other end of said tubular housing for joining said tubular housing to means for lowering said tool into a short radius curve of a deviated well, said connector means having a passageway for conducting fluids from the interior of said tool lowering means to the exterior of said tubular housing, said connector means and said tubular housing having means to prevent fluids from entering said tubular housing, a tubular, non-magnetic sleeve adapted to be received on a portion of said tubular housing; and means for securing said tubular sleeve to said tubular housing.

8. The tool of claim 7, wherein said tubular non-magnetic sleeve has connected thereto, around its outside surface a plurality of spaced apart wear members which extend radially from the outside surface of said tubular sleeve, the wear member defining the circumference of said tubular sleeve.

9. The tool of claims 7 or 8, wherein the circumference of the tubular sleeve is essentially equal to the maximum circumference of said connector means.

10. The tool of claim 9, wherein the distance between said tubular sleeve and said connector means can be varied by varying the point of connection of said tubular sleeve on said tubular housing.

11. The tool of claim 7, wherein said closure means is adapted to receive and house a portion of said survey tool.

12. The tool of claims 7 or 11, wherein said connector means is adapted to receive and house a portion of said survey tool.

13. The tool of claim 7, wherein said means to prevent fluids from entering said tubular housing is an O-ring.

14. The tool of claim 13, wherein said means to prevent fluids from entering said tubular housing consists of at least two juxtaposed O-ring seals.

* * * * *